US011579546B2

(12) United States Patent
Miyake et al.

(10) Patent No.: US 11,579,546 B2
(45) Date of Patent: Feb. 14, 2023

(54) IMAGING SYSTEM WITH TRANSFER ROLLER

(71) Applicant: Hewlett-Packard Development Company, L.P., Spring, TX (US)

(72) Inventors: Koji Miyake, Yokohama (JP); Satoru Hori, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,106

(22) PCT Filed: Aug. 21, 2020

(86) PCT No.: PCT/US2020/047377
§ 371 (c)(1),
(2) Date: Jun. 15, 2021

(87) PCT Pub. No.: WO2021/045914
PCT Pub. Date: Mar. 11, 2021

(65) Prior Publication Data

US 2022/0187742 A1 Jun. 16, 2022

(30) Foreign Application Priority Data

Sep. 3, 2019 (JP) ..... JP2019-160219

(51) Int. Cl.
*G03G 15/16* (2006.01)

(52) U.S. Cl.
CPC ..... *G03G 15/1685* (2013.01); *G03G 15/1615* (2013.01)

(58) Field of Classification Search
CPC ..... G03G 15/167; G03G 15/1675; G03G 15/168; G03G 15/1685
See application file for complete search history.

(56) References Cited

U.S. PATENT DOCUMENTS

| | | | | |
|---|---|---|---|---|
| 6,487,386 | B1 * | 11/2002 | Zimmer | G03G 15/1625 399/311 |
| 2012/0219333 | A1 * | 8/2012 | Namba | G03G 15/1685 399/313 |
| 2017/0285553 | A1 * | 10/2017 | Tano | G03G 21/0017 |
| 2018/0136592 | A1 * | 5/2018 | Takahashi | G03G 15/1615 |
| 2019/0317425 | A1 * | 10/2019 | Shimodaira | G03G 15/1675 |

FOREIGN PATENT DOCUMENTS

| | | | | |
|---|---|---|---|---|
| CN | 204009368 | U | 12/2014 | |
| JP | 1993094104 | A | 4/1993 | |
| JP | 2004151616 | A * | 5/2004 | |
| JP | 2006317627 | A | 11/2006 | |
| JP | 2017021110 | A | 1/2017 | |
| JP | 2017223864 | A | 12/2017 | |
| JP | 2018124408 | A | 8/2018 | |
| WO | WO-2020257287 | A1 * | 12/2020 | G03G 15/161 |

* cited by examiner

*Primary Examiner* — Carla J Therrien
(74) *Attorney, Agent, or Firm* — Foley & Lardner LLP

(57) ABSTRACT

An imaging system includes a transfer belt that is rotatable, a transfer roller that contacts the transfer belt, and a conductive device that contacts a surface of the transfer roller, to supply a bias to the transfer roller. The transfer roller has a hollow portion.

14 Claims, 8 Drawing Sheets

IMAGING SYSTEM WITH TRANSFER ROLLER

BACKGROUND

An imaging apparatus includes a transfer unit which transfers a toner image to a printing medium. The transfer unit may include a transfer belt which carries a toner image, a transfer roller which contacts the transfer belt, and a power supply roller which supplies a transfer bias to the transfer roller. The transfer roller includes a shaft that functions as a conductive shaft core. An ionic conductive agent such as epichlorohydrin rubber is used for the transfer roller. The transfer belt is connected to a ground and the power supply roller is connected to a power source. A transfer current is supplied from the power source to a shaft of the transfer roller through the power supply roller.

DETAILED DESCRIPTION

In the following description, with reference to the drawings, the same reference numbers are assigned to the same components or to similar components having the same function, and overlapping description is omitted.

An example imaging system will be described. An imaging system may include an imaging apparatus such as a printer, or the like according to some examples, or a device or system within an imaging apparatus according to other examples.

Figure 1:
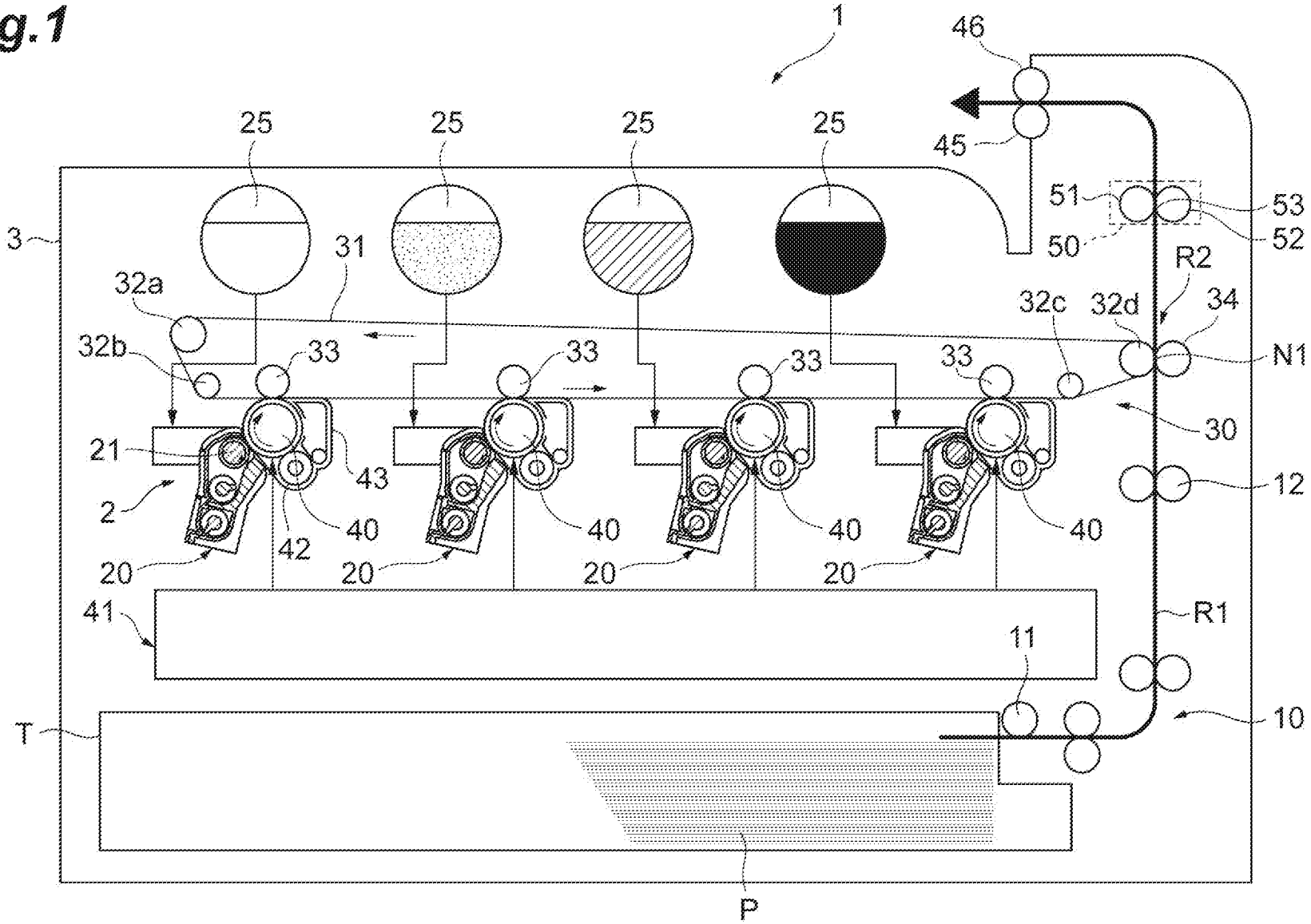
FIG. 1 is a schematic diagram of an imaging apparatus including an example transfer device.

With reference to FIG. 1, an example imaging apparatus 1 may form a color image by using respective colors of magenta, yellow, cyan, and black. The imaging apparatus 1 includes, for example, a recording medium conveying device 10, a plurality of developing devices 20, a transfer unit (or transfer device) 30, a plurality of photosensitive members 40, and a fixing device 50. The recording medium conveying device 10 conveys a printing medium P. The printing medium P may include paper (e.g., a paper sheet) as an example. The photosensitive member 40 forms an electrostatic latent image and the developing device 20 develops the electrostatic latent image. The transfer unit (or device) 30 secondarily transfers a toner image to the printing medium P. For example, the fixing device 50 fixes the toner image to the printing medium P.

As an example, the recording medium conveying device 10 includes a pickup roller 11 which conveys the printing medium P on which an image is to be formed, along a conveyance path R1 and a registration roller 12 which is provided downstream the pickup roller 11 in the conveyance direction of the conveyance path R1. The printing medium P is stored so as to be stacked on a tray T and is picked up and conveyed by the pickup roller 11. The pickup roller 11 may be located in the vicinity of an exit of the tray T for the printing medium P.

The registration roller 12 conveys the printing medium P picked up by the pickup roller 11. A secondary transfer region R2 in which a toner image is transferred to the printing medium P is provided downstream the registration roller 12 in the conveyance path R1 of the printing medium P. The registration roller 12 directs the printing medium P to reach the secondary transfer region R2 through the conveyance path R1 at a timing in which the toner image to be transferred to the printing medium P, reaches the secondary transfer region R2.

One developing device 20 may be provided for each color, and accordingly, the imaging apparatus 1 may include four developing devices 20. Each developing device 20 includes a developing roller 21 which carries a toner on the photosensitive member 40. In the developing device 20, for example, the toner and the carrier are adjusted to a predetermined mixing ratio and the toner and the carrier are mixed so as to uniformly disperse the toner with the carrier. The developer is carried by the developing roller 21. The developing roller 21 rotates so as to convey the developer to a region facing the photosensitive member 40. Then, the toner in the developer carried by the developing roller 21 moves to the electrostatic latent image of the photosensitive member 40 so that the electrostatic latent image is developed.

The transfer unit (or device) 30 conveys, for example, the toner image formed by the developing device 20 and the photosensitive member 40 to the secondary transfer region R2. In some examples, an image developed by the photosensitive member 40 is transferred to the transfer unit 30. As an example, the transfer unit 30 includes a transfer belt 31 tension rollers 32*a*, 32*b*, and 32*c*, a driving roller 32*d*, a transfer roller 33 corresponding to a primary transfer roller, and a transfer roller 34 corresponding to a secondary transfer roller.

The transfer belt 31 is tensioned by, for example, the tension rollers 32*a*, 32*b*, and 32*c* and the driving roller 32*d*. The driving roller 32*d* is a backup roller which tensions the transfer belt 31 along with the tension rollers 32*a*, 32*b*, and 32*c*. One transfer roller 33 may be provided for each color. Each transfer roller 33 sandwiches the transfer belt 31 along with each photosensitive member 40. The transfer roller 34 sandwiches the transfer belt 31 against the driving roller 32*d*. The transfer belt 31 is, for example, an endless belt which moves in a circulating manner by the rotation of the tension rollers 32*a*, 32*b*, and 32*c* and the driving roller 32*d*. The transfer roller 33 presses against the photosensitive member 40 from the inner peripheral side of the transfer belt 31. The transfer roller 34 presses against the driving roller 32*d* from the outer peripheral side of the transfer belt 31.

The photosensitive member 40 is a photosensitive drum as an example and one photosensitive member 40 may be provided for each color such that the imaging apparatus 1 includes four photosensitive members 40 arranged along the movement direction of the transfer belt 31. For each photosensitive member 40, the developing device 20, an exposure unit (or exposure device) 41, a charging device 42, and a cleaning device 43 are positioned to face the outer peripheral surface of the photosensitive member 40.

In some examples, the imaging apparatus 1 includes a process cartridge 2 in which the developing device 20, the photosensitive member 40, the charging device 42, and the cleaning device 43 are integrally provided and a housing 3 to and from which the process cartridge 2 is attached and detached. The process cartridge 2 may be inserted into and extracted from the housing 3 by opening the door of the housing 3, such that the process cartridge is attachable to and detachable from the housing 3.

In some examples, the charging device 42 may uniformly charge the outer peripheral surface of the photosensitive member 40 to a predetermined potential. The charging device 42 may include, for example, a charging roller which rotates so as to follow the rotation of the photosensitive member 40. The exposure unit (or device) 41 exposes the outer peripheral surface of the photosensitive member 40 having been charged by the charging device 42, in accordance with an image formed on the printing medium P. A potential of a portion exposed by the exposure unit 41 in the outer peripheral surface of the photosensitive member 40 changes so that an electrostatic latent image is formed on the outer peripheral surface of the photosensitive member 40.

Each of the plurality of developing devices 20 is disposed so as to face, for example, the toner tank 25. The toner tanks 25 are respectively filled with, for example, magenta, yellow, cyan, and black toners. The toner is supplied from the toner tanks 25 to the respective developing devices 20. Each developing device 20 develops the electrostatic latent image with the toner supplied thereto and forms a toner image on the outer peripheral surface of the photosensitive member 40. The toner image formed on the outer peripheral surface of the photosensitive member 40 is primarily transferred to the transfer belt 31 and the toner remaining on the outer peripheral surface of the photosensitive member 40 after the primary transfer operation has completed, is removed by the cleaning device 43.

The fixing device 50 may fix to the printing medium P, the toner image having been secondarily transferred from the transfer belt 31 to the printing medium P. As an example, the fixing device 50 includes a heating roller 51 which heats the printing medium P and fixes the toner image to the printing medium P and a pressing roller 52 which presses against the heating roller 51. The heating roller 51 and the pressing roller 52 may have a substantially cylindrical shape.

As an example, a heat source such as a halogen lamp is provided inside the heating roller 51. Additionally, a heat source such as a halogen lamp may be provided inside the pressing roller 52. A fixing nip portion 53 which is a fixing region for the printing medium P is formed between the heating roller 51 and the pressing roller 52. When the printing medium P passes through the fixing nip portion 53, the toner of the toner image is melted and fixed to the printing medium P.

An example imaging method or imaging process that may be carried out by the imaging apparatus 1 will be described. In an example printing process using the example imaging apparatus 1, when an image signal of a recording target image is input to the imaging apparatus 1, the pickup roller 11 rotates so that the printing medium P stacked on the tray T is picked up and the printing medium P is conveyed along the conveyance path R1. The charging device 42 uniformly charges the outer peripheral surface of the photosensitive member 40 to a predetermined potential based on the image signal. The outer peripheral surface of the photosensitive member 40 is irradiated with a laser beam by the exposure unit 41 so that an electrostatic latent image is formed on the outer peripheral surface of the photosensitive member 40.

The developing device 20 performs a developing operation by forming a toner image on the photosensitive member 40. In some examples, one toner image is primarily transferred from each photosensitive member 40 to the transfer belt 31 at a region where the photosensitive member 40 faces the transfer belt 31. In some examples, the toner images respectively formed on the plurality of photosensitive members 40 are sequentially layered or superimposed on the transfer belt 31 so that a single composite toner image is formed. The composite toner image is secondarily transferred to the printing medium P conveyed from the recording medium conveying device 10 in the secondary transfer region R2 including a first nip portion N1 in which the driving roller 32*d* and the transfer roller 34 face each other.

The printing medium P to which the composite toner image is secondarily transferred is conveyed from the secondary transfer region R2 to the fixing device 50, The fixing device 50 applies, for example, heat and pressure to the printing medium P passing through the fixing nip portion 53 so that the composite toner image is melted and fixed to the printing medium P. The printing medium P having passed through the fixing nip portion 53 of the fixing device 50 is discharged to the outside of the imaging apparatus 1 by, for example, discharge rollers 45 and 46.

An example transfer unit (or transfer device) 30 will be described, with reference to FIG. 2.

The example transfer unit 30 may include a conductive device 35, a power source 36, and a support member 37 in addition to the transfer belt 31 and the driving roller 32*d*. The conductive device 35 functions as, for example, a power supply member that supplies power from the outside of the transfer roller 34 to the transfer roller 34. The conductive device 35 has, for example, an electrical resistance lower than that of the transfer roller 34. The conductive device 35 may physically dean (e.g., mechanically clean) the toner of the surface 34*b* by contacting the surface 34*b* of the transfer roller 34.

The conductive device 35 is, for example, a roller-shaped conductive roller including, for example, a metallic rigid body. The conductive device 35 may be a cleaning roller which cleans the surface 34*b* of the transfer roller 34. The conductive device 35 is, for example, a roller that follows the transfer roller 34. The conductive device 35 forms a second nip portion N2 between the conductive device and the transfer roller 34. The first nip portion N1 formed between the driving roller 32*d* and the transfer roller 34 is set to a constant pressure by the driving roller 32*d*. The first nip portion corresponds to one of holding portions for supporting the transfer roller 34. In some examples, a distance D from the second nip portion N2 to the first nip portion N1 is equal to or greater than a thickness A of the transfer roller 34 which will be described below.

An inter-axis distance between the center axis of the driving roller 32*d* and the center axis of the conductive device 35 may be a fixed distance. In comparative examples, the transfer unit releases or moves the transfer roller 34 depending on differences in the thickness of the printing medium P, in order to absorb (compensate for) a difference in the thickness of the printing medium P. According to examples, the transfer roller 34 may be operable with a fixed or set inter-axis distance between the center axis of the driving roller 32*d* and the center axis of the conductive device 35 as described above given that the transfer roller 34 is adapted to absorb a change in the printing medium P. Accordingly, the configuration of the transfer unit 30 may be simplified, by doing without any release mechanism for the transfer roller 34 that compensates for a change in the thickness of the printing medium P.

In comparative examples, the transfer roller may be pressed against the transfer belt via a spring. In the example transfer unit (or device) 30, the transfer roller 34 may include a tubular body (e.g., foam layer) 34*c* and a hollow section 34*d* inside the tubular body 34*c* which render the transfer roller 34 to be deformable. Accordingly, the position of the driving roller 32*d* may be set relative to the position of the conductive device 35 without any spring, since the transfer roller 34 has elasticity and consequently provides the function of a spring. Accordingly, the example transfer unit (or device) 30 may be achieved with a simpler and easier configuration. Consequently, the example transfer unit (or device) 30 may be achieved at lower cost. In the case of the above-described example, the position of the driving roller 32*d* relative to the conductive device 35 is fixed. The fixed position of the driving roller 32*d* or the fixed position of the conductive device 35 can be changed in response to the environment in which the imaging apparatus 1 is disposed, the type of the printing medium P, and the like.

In the example transfer unit (device) 30, the conductive device 35 may be disposed so as to press the transfer roller 34 against the transfer belt 31. In some examples, the conductive device 35 may be movable by opening and closing the door of the housing 3, to move away from the transfer roller 34 for ease of replacing the transfer roller 34 when the door is opened and to support the transfer roller 34 when the door is closed. Accordingly, the transfer unit 30 may move the conductive device 35 for example in order to maintain contact with the transfer roller 34 and thereby support the transfer roller 34, to be moved away from the transfer roller 34 to improve the exchangeability (ease of replacing) of the transfer roller 34, or the like, by opening and closing the door of the housing 3. For example, the conductive device 35 may move in a direction to press the transfer roller against the transfer belt 31 at the time of closing the door of the housing 3, to support the transfer roller 34. As an example, the transfer roller 34 may be connected by a hook, to a shaft provided in the housing 3 when the door of the housing 3 is closed, and the transfer roller 34 may be released from the shaft by an overstroke when the door of the housing 3 is opened.

In some examples, the transfer unit 30 includes the power source 36 which supplies a bias to the transfer roller 34 (applies a bias voltage) through the conductive device 35. Each of the driving roller 32*d* and the power source 36 may be electrically connected to a ground. The power source 36 includes a supply path 36*b* which is electrically connected to the conductive device 35 and supplies a bias to the conductive device 35. The bias supplied to the conductive device 35 is supplied from a portion contacting the conductive device 35 in the surface 34*b* of the transfer roller 34 to the transfer roller 34.

The power source 36 supplies a bias to the transfer roller 34 through the conductive device 35, for example, several times during a printing operation, a cleaning operation of the transfer roller 34, and a measurement operation of the electrical resistance of the transfer roller 34. For example, the power source 36 supplies at least one of a transfer bias, a cleaning bias, and an electrical resistance measurement bias. For example, when the toner is negatively charged, the power source 36 supplies a positive bias to the transfer roller 34 through the conductive device 35, draws the toner to the printing medium P, and transfers the toner image to the printing medium P.

When the toner is negatively charged, the power source 36 supplies a negative bias to the transfer roller 34 so as to clean (remove) the toner attached to the transfer roller 34, for example, during a cleaning operation. For example, the electrical resistance of the transfer roller 34 may be measured while the power source 36 supplies a positive bias to the transfer roller 34.

Figure 2:
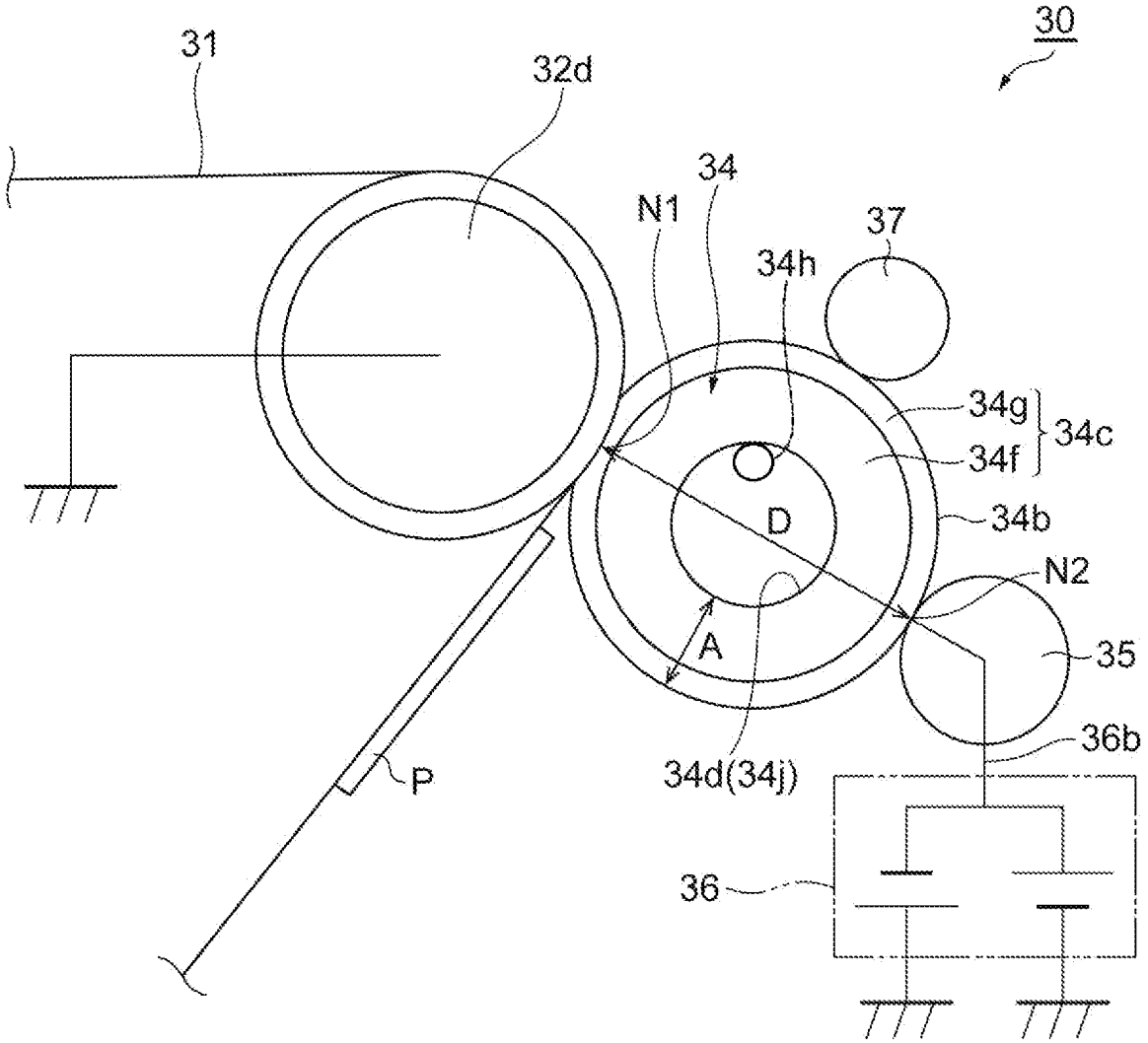
FIG. 2 is a schematic side view illustrating the example transfer device of FIG. 1.
Figure 3:
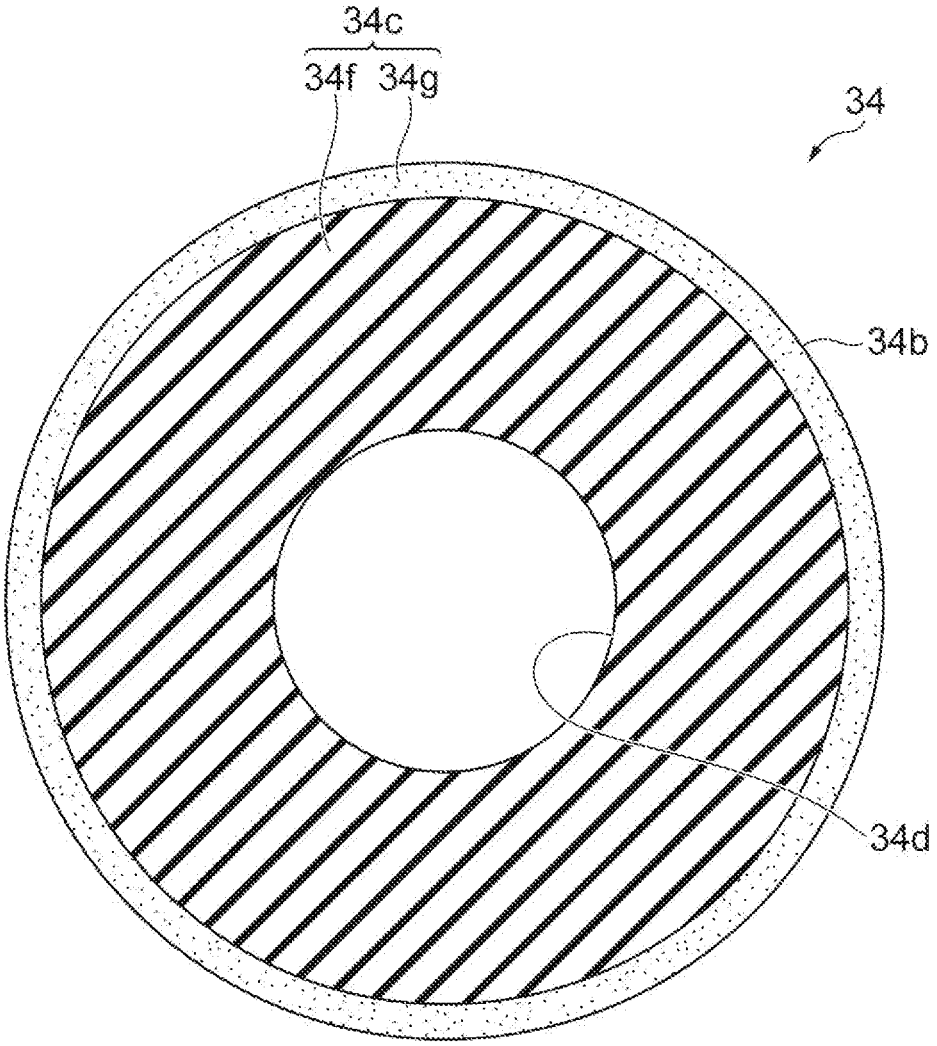
FIG. 3 is a schematic cross-sectional view of a transfer roller of the transfer device of FIG. 2.

FIG. 3 is an enlarged cross-sectional view of the example transfer roller 34, As illustrated in FIGS. 2 and 3, the transfer roller 34 presses the transfer belt 31 against the driving roller 32*d* and forms the first nip portion N1 corresponding to a transfer nip portion between the transfer roller and the transfer belt 31. The transfer roller 34 contains, for example, an ionic conductive agent.

The transfer roller 34 includes, for example, a foam layer (forming the tubular body 34*c*), and the foam layer (34*c*) may be formed of closed cells or open cells. The foam layer (34*c*) may be formed of an elastic material (e.g., highly flexible material) and may have a sponge shape. In this case, the surface 34*b* of the transfer roller 34 is made of foam and fine holes are formed in the surface 34*b* of the foam layer (34*c*).

The hollow section 34*d* is formed inside the foam layer (34*c*) of the transfer roller 34 in the radial direction, and extends in the axial direction of the transfer roller 34. The cross-sectional shape of the hollow section 34*d* when the transfer roller 34 is cut along a plane extending in a direction orthogonal to the axial direction of the transfer roller 34 is, for example, a substantially circular shape. However, the cross-sectional shape of the hollow section 34*d* may be a shape other than a circular shape such as an oval shape or a polygonal shape. In addition, the cross-sectional shape of the hollow section may change when the transfer roller 34 is deformed by pressure for example.

The hollow section 34*d* of the transfer roller 34 is formed by, for example, removing the shaft from a transfer roller that includes a shaft. In this case, the transfer roller 34 is a shaftless roller (e.g., without any shaft), The transfer roller 34 is associated with the thickness A which is the thickness of the foam layer (34*c*) in the radial direction and includes the hollow section 34*d*, such that the transfer roller is deformable by an external force.

The foam layer (34*c*) of the transfer roller 34 may include a base layer 34*f* which is an innermost layer of the transfer roller 34 (e.g, located at the inside of the transfer roller 34 in the radial direction) and a surface layer 34*g* which is an outermost layer of the transfer roller 34 (located at the outside of the base layer 34*f* in the radial direction). For example, the thickness of the base layer 34*f* may be greater than the thickness of the surface layer 34*g*. The material of the base layer 34*f* may be, for example, a rubber material containing acrylonitrile butadiene rubber (NBR: nitrile butadiene rubber) or an elastic material containing urethane. The material of the surface layer 34*g* is, for example, an elastic material containing urethane. Additionally, the surface layer 34*g* may be subjected to an ultraviolet curing treatment.

The volume resistance value of the surface layer 34*g* may be greater than the volume resistance value of the base layer 34*f* and the surface resistivity of the surface layer 34*g* may be greater than the surface resistivity of the base layer 34*f*. For example, the volume resistance value of the base layer 34*f* may be of approximately 6.5 to 7.5 log Ω and the volume resistance value of the surface layer 34*g* may be of approximately 8.0 to 10.0 log Ω in some examples. In some examples, the surface resistivity of the base layer 34*f* may be of approximately 8.5 to 9.5 log Ω/□ (or log Ω/square) and the surface resistivity of the surface layer 34*g* may be of approximately 9.0 to 11.0 log Ω/square.

The transfer roller 34 may be held (or supported) by holding portions including at least three points of contact with the transfer roller 34 (e.g., at least three-point holding portions) in which the holding portions are provided at least in part, by the transfer belt 31 and the conductive device 35. In some examples, the transfer roller 34 may be held (or supported) by three parts including the transfer belt 31, the transfer roller 34, and the support member 37. A "holding portion" may refer to a portion which contacts and holds the transfer roller 34. In some examples, one holding portion is provided at a position of the transfer roller 34 opposite the transfer nip portion (the first nip portion N1). In some examples, the holding portion (the second nip portion N2) formed between the conductive device 35 and the transfer roller 34 is provided at a position opposite the first nip portion N1 relative to a central axis of the transfer roller 34. The second nip portion N2 corresponds to, for example, a nip portion formed with the conductive device 35.

In some examples, the transfer roller 34 may be held through holding portions at four or more points and may be held by four or more parts. The support member 37 is a part or member for supporting the transfer roller 34 and is, for example, a part or member different from (separate from) the transfer belt 31 and the conductive device 35. In this case, the support member 37, together with the transfer belt 31 and the conductive device 35, hold the transfer roller 34.

For example, the support member 37 is provided in a portion between the first nip portion N1 and the second nip portion N2 in the circumferential direction of the transfer roller 34. As an example, the support member 37 is a support roller that rotates along with the transfer roller 34. In some examples, the outer diameter of the support member 37 may be less than the outer diameter of the transfer roller 34. In some examples, the support member 37 is formed of metal and the power source 36 may supply a bias to the transfer roller 34 through the support member 37. The shape and function of the support member 37 can be suitably modified.

In some examples, the support member 37 is provided on a downstream side of the transfer belt 31 and on an upstream side of the conductive device 35 in the rotation track (in a rotational movement) of the surface 34*b* of the transfer roller 34. In other examples, the support member 37 may be provided at the downstream side of the conductive device 35 and the upstream side of the transfer belt 31 in the rotational movement of the surface 34*b* of the transfer roller 34 and the arrangement position of the support member 37 can be suitably modified. Further, the transfer unit 30 includes one support member 37 as an example, but may include a plurality of support members 37.

Figure 4:
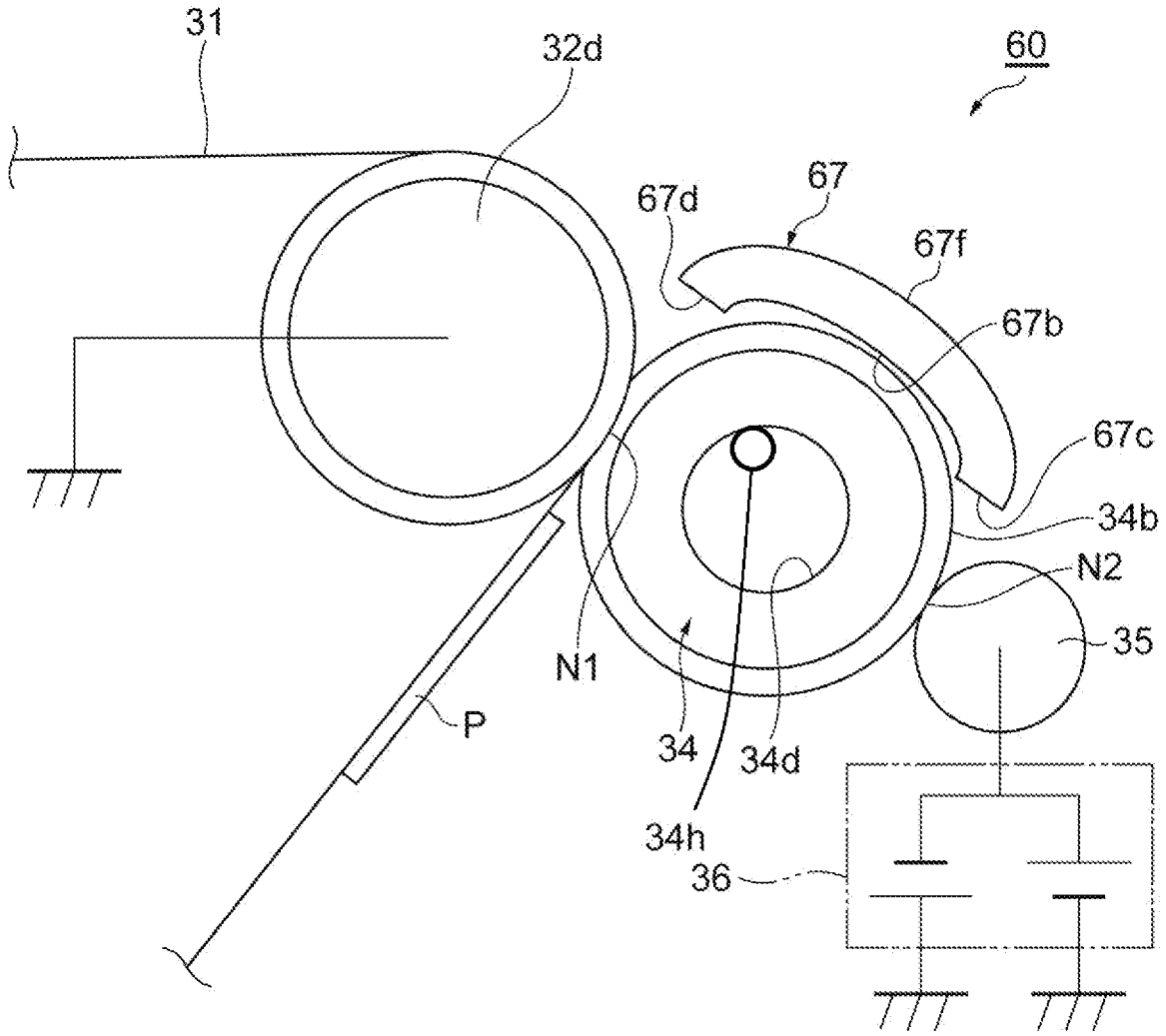
FIG. 4 is a schematic side view illustrating a transfer device according to a modified example.

FIG. 4 is a diagram schematically illustrating a transfer unit (or transfer device) 60 including a support member 67 according to a modified example, having a curved surface 67*b* that substantially follows the surface 34*b* of the transfer roller 34. For example, the transfer unit (or device) 60 may include the support member 67 corresponding to a curved surface member provided with the curved surface 67*b* that is curved to substantially follows the surface 34*b* of the transfer roller 34, in lieu of the support member 37 (FIG. 2) corresponding to the support roller. The support member 67 supports the transfer roller 34 in such a manner that the curved surface 67*b* contacts the surface 34*b*. However, the curved surface 67*b* may be slightly spaced apart from the surface 34*b* of the transfer roller 34 when the transfer roller 34 does not rotate.

In some examples, the curved surface 67*b* of the support member 67 is formed in an elliptical arc shape. The shape of the curved surface 67*b* may be a shape other than an elliptical arc shape such as an arc shape or a parabolic shape. The curvature of the curved surface 67*b* is less than, for example, the curvature of the surface 34*b* of the transfer roller 34. That is, the curvature radius of the curved surface 67*b* is greater than the curvature radius of the surface 34*b* of the transfer roller 34.

In some examples, the support member 67 illustrated in FIG. 4 includes a first planar face 67*c* located at one end of the curved surface 67*b*, a second planar face 67*d* located at the other end of the curved surface 67*b*, and an outer peripheral surface 67*f* connecting the first planar face 67*c* and the second planar face 67*d* to each other and extending along the curved surface 67*b*. However, the shape of the support member 67 is not limited to a shape including the first planar face 67*c*, the second planar face 67*d*, and the outer peripheral surface 67*f* and can be appropriately changed.

Figure 5:
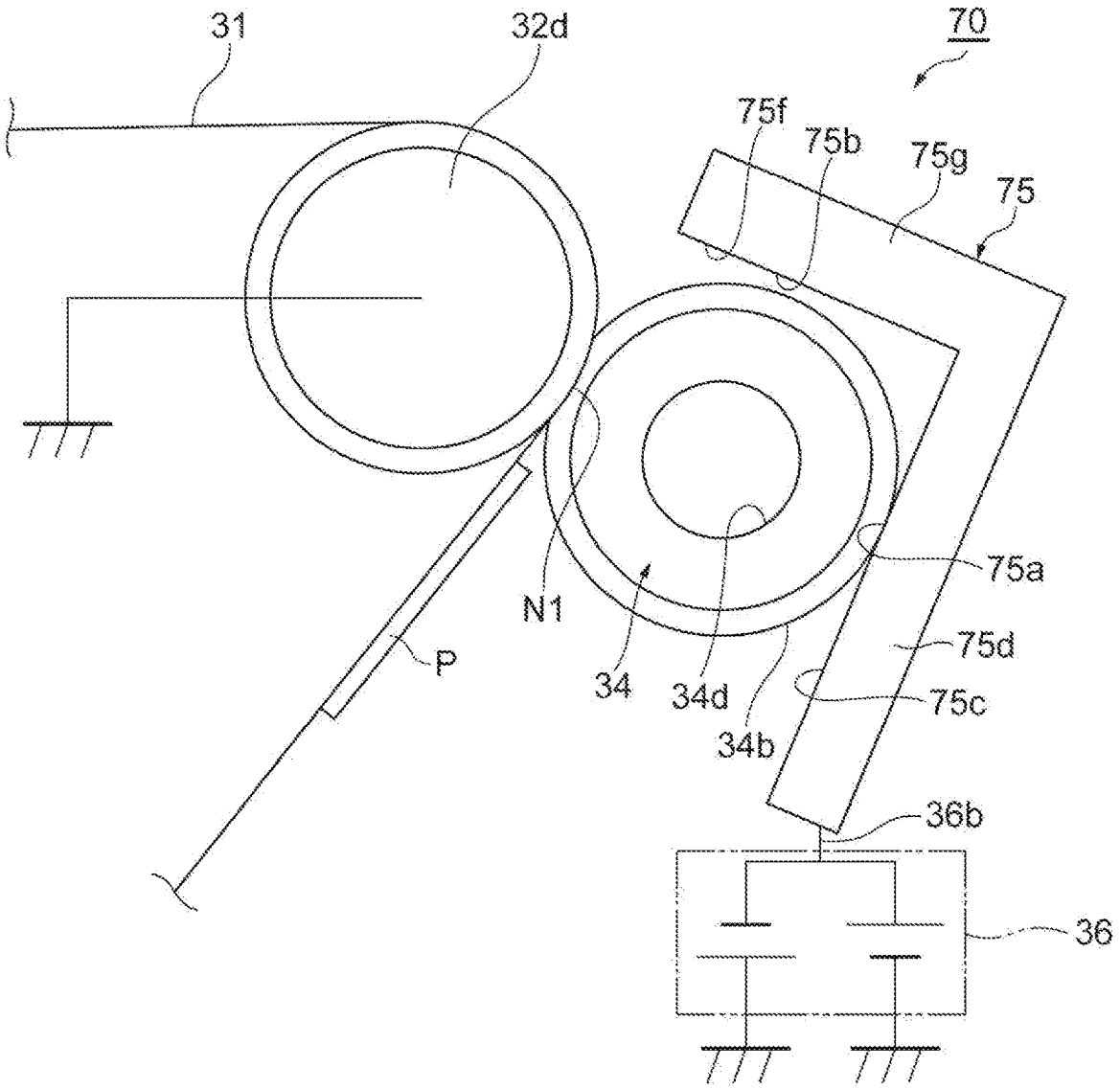
FIG. 5 is a schematic side view illustrating a transfer device according to another modified example.

FIG. 5 is a diagram schematically illustrating a transfer unit 70 including a conductive device 75 according to a modified example. As illustrated in FIG. 5, the transfer unit 70 includes the conductive device 75 having a different shape from the conductive device 35 (FIGS. 2 and 4) instead of the support member 37 and the conductive device 35 corresponding to the conductive roller. The conductive device 75 is formed of, for example, metal.

The conductive device 75 includes two contact points 75*a*, 75*b* contacting the surface 34*b* of the transfer roller 34 and supports the transfer roller 34, for example, at two points via the two contact points 75*a*, 75*b*, In this case, the transfer roller 34 may be held by the transfer belt 31 and two contact points 75*b* of the conductive device 75.

For example, the conductive device 75 illustrated in FIG. 5 has a recessed shape (L shape) that covers or extends adjacent a part of the transfer roller 34. In some examples, the conductive device 75 may include a first arm (or first portion) 75*d* and a second arm (or second portion) 75*g*. The first portion 75*d* includes a first end that is connected to the supply path 36*b* of the power source 36 and includes an inner surface 75*c* with a first contact point 75*a*. The second portion 75*g* extends toward the driving roller 32*d* from a second end of the first portion 75*d* opposite the first end, and includes an inner surface 75*f* with a second contact point 75*b*. The second contact point 75*b* of the second portion 75*g* may be slightly spaced apart from the surface 34*b* of the transfer roller 34 when the transfer roller 34 does not rotate. The shape of the conductive device 75 is not limited to the shape including the first portion 75*d* and the second portion 75*g* and can be suitably modified depending on examples.

Figure 6:
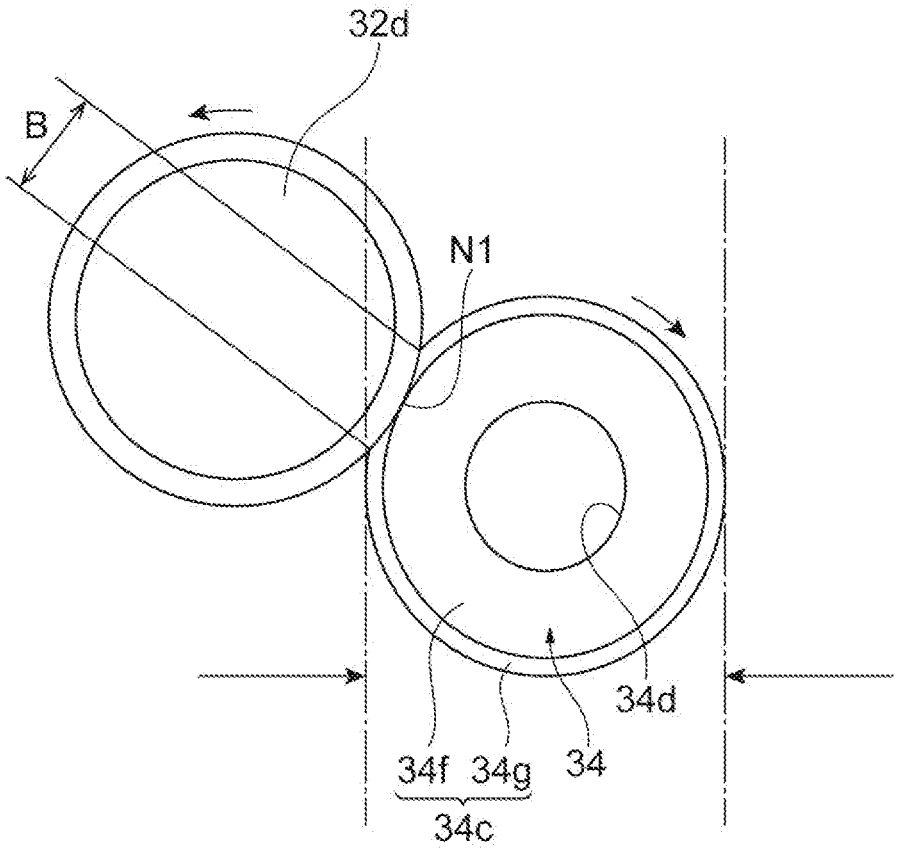
FIG. 6 is a schematic side view of the transfer roller and a driving roller of the transfer device of FIG. 2, illustrating a state in which the transfer roller is deformed.
Figure 7:
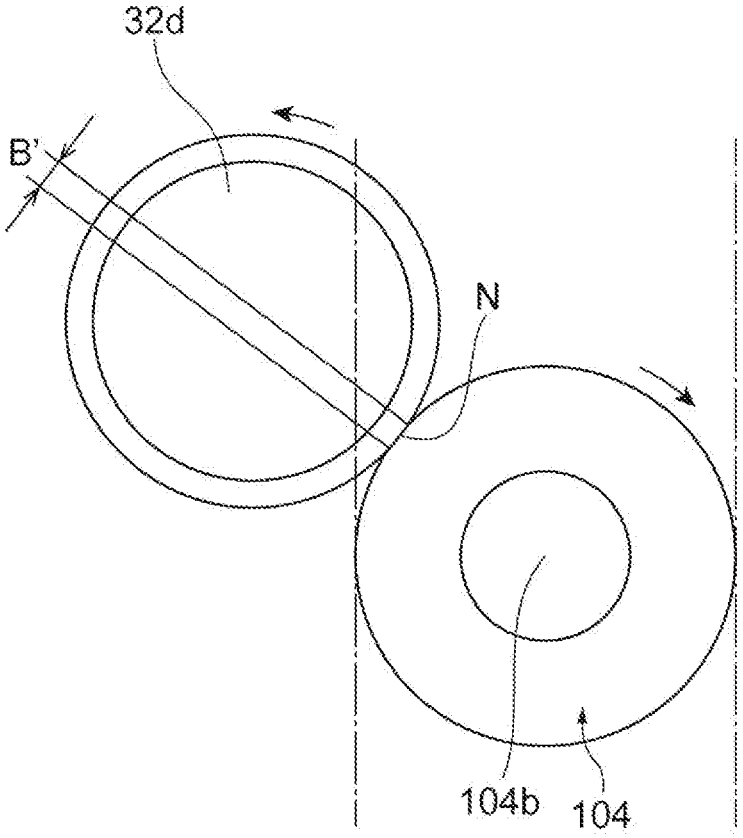
FIG. 7 is a schematic side view illustrating a transfer roller of a transfer unit of a comparative example.

FIG. 6 is a diagram schematically illustrating the first nip portion N1 which is the transfer nip portion between the transfer roller 34 and the driving roller 32*d*. FIG. 7 is a diagram schematically illustrating the transfer nip portion N between the driving roller 32*d* and a transfer roller 104 according to a comparative example, including a shaft 104*b* (without any hollow section).

In the above-described examples, with reference to FIG. 6, the transfer roller 34 includes the hollow section 34*d*, and the tubular body (e.g., the foam layer) 34*c* having a thickness in the radial direction of the transfer roller 34. Accordingly, the transfer roller 34 is deformable, for example when subjected to an external force, so as to provide a nip width B of the transfer nip portion (the first nip portion N1) that is wider than the width B' of transfer nip portion N in the transfer roller 104 of the comparative example (FIG. 7).

Accordingly, since the nip width B in the transfer roller 34 including the hollow section 34*d*, is wider than the nip width B' of the transfer roller 104 of the comparative example, a current (transfer bias) for a transfer operation can flow more easily, so as to improve the transfer quality to the printing medium P. In addition, the hollow section 34*d* decreases the weight of the transfer roller 34.

The transfer roller 34 including the hollow section 34*d* is more easily deformable than the transfer roller 104 of the comparative example including the shaft 104*b* without any hollow section. Further, since the curvature of the transfer nip portion increases as the nip width narrows and conversely, the curvature of the transfer nip portion decreases as the nip width widens, the nip portion N1 formed by the transfer roller 34 (e.g., FIG. 6) may be less curved than the nip portion N formed by the transfer roller 104 of the comparative example, so as to increase the transfer quality, for example by inhibiting a separation error of the printing medium P from the transfer nip portion N. For example, when the curvature is pronounced, the printing medium P may be deviated from the original path, toward the driving roller 32*d* from the transfer nip portion N. In addition, the transfer roller 34 may form a wider nip portion N1 with less pressure or force than the transfer roller 104. Even when a relatively wide transfer nip portion N is formed by applying a relatively strong force to the transfer roller 104, a separation error of the printing medium P from the transfer nip portion N may still occur.

The example transfer roller 34 with the hollow section 34*d* is more easily deformed by an external force, to form a relatively wide nip width B. Accordingly, the occurrence of a separation error is inhibited by minimizing the curvature of the first nip portion N1 In addition, the wider nip width B can be formed even when the pressure or force at the first nip portion N1 is low, to further inhibit any separation error.

In the transfer roller 34, the volume resistance value of the surface layer 34*g* may be greater than the volume resistance value of the base layer 34*f* and the surface resistivity of the surface layer 34*g* may be greater than the surface resistivity of the base layer 34*f*. Accordingly, the electrical resistance of the base layer 34*f* is less than the electrical resistance of the surface layer 34*g*, and the direction of the current passing through the transfer roller 34 can be directed to the inside of the transfer roller 34 in the radial direction. Accordingly, the ionic conductive agent of the transfer roller 34 is inhibited from collecting on the surface 34*b* of the transfer roller 34, which in turn inhibits an increase in the electrical resistance of the transfer roller 34, so as to extend the life of the transfer roller 34.

With reference to FIG. 2, the transfer roller 34 may be held or supported by holding portions including at least three points of contact with the transfer roller 34 (e.g., at least three-point holding portions), in order to achieve a more stable rotation of the transfer roller 34. The holding portions may be included at least in part, in the transfer belt 31 and the conductive device 35. Accordingly, the three contact points (points of contact) may be provided at least in part, by the transfer belt 31 and the conductive device 35.

A distance D from the first nip portion N1 (the transfer nip portion) to the second nip portion N2 (the nip portion formed by the conductive device 35) may be equal to or greater than the thickness A of the transfer roller 34, to position the conductive device 35 at a suitable distance from the first nip portion N1, such that the path of the bias is formed to flow radially inwardly and radially outwardly. Accordingly, the path of the bias from the conductive device 35 to the transfer roller 34 can be more reliably formed at both sides of the transfer roller 34, from the outside of the transfer roller 34 to the inside in the radial direction, and from the inside of the transfer roller 34 to the outside in the radial direction. Consequently, the ionic conductive agent is inhibited from collecting on the side of the surface 34*b*, in order to more reliably suppress or inhibit an increase in the electrical resistance of the transfer roller 34.

The example transfer roller 34 may be a shaftless roller (e.g., without any shaft). For example, the transfer roller 34 can be formed by removing the shaft from an existing transfer roller. Accordingly, the shaftless roller may be achieved with few modifications by adapting a standard roller with a shaft, to benefit of a decrease in the weight of the transfer roller 34, a wider nip width B, and reduced occurrence of separation error.

In some examples, with reference to FIG. 2, the transfer roller 34 may include a shaft 34*h* which extends in the axial direction of the transfer roller 34 and a hole portion 34*j* which has an inner diameter greater than the outer diameter of the shaft 34*h*, in order to decrease the weight of the transfer roller 34, to secure the wide nip width B, and to suppress or inhibit the separation error as compared with the transfer roller 104 including the shaft 104*b* without the hole portion 34*j* (FIG. 7). The shaft 34*h* may improve a stability of the rotation of the transfer roller 34.

The driving roller 32*d* may be a backup roller which tensions the transfer belt 31 and the first nip portion N1 may be set to a constant pressure by the driving roller 32*d*, to more reliably inhibit the occurrence of a separation error of the printing medium P.

The bias supplied to the conductive device 35 may be supplied to the transfer roller 34, via a portion of the surface 34*b* of the transfer roller 34 (the second nip portion N2) that is in contact with the conductive device 35. In this case, the path of the bias from the conductive device 35 to the transfer roller 34 can be reliably formed at both sides from the outside (e.g., the surface 34*b*) of the transfer roller 34 to the inside in the radial direction, and from the inside (e.g., the surface 34*b*) of the transfer roller 34 to the outside in the radial direction, Consequently; an increase in the electrical resistance of the transfer roller 34 can be more reliably suppressed.

Figure 8:
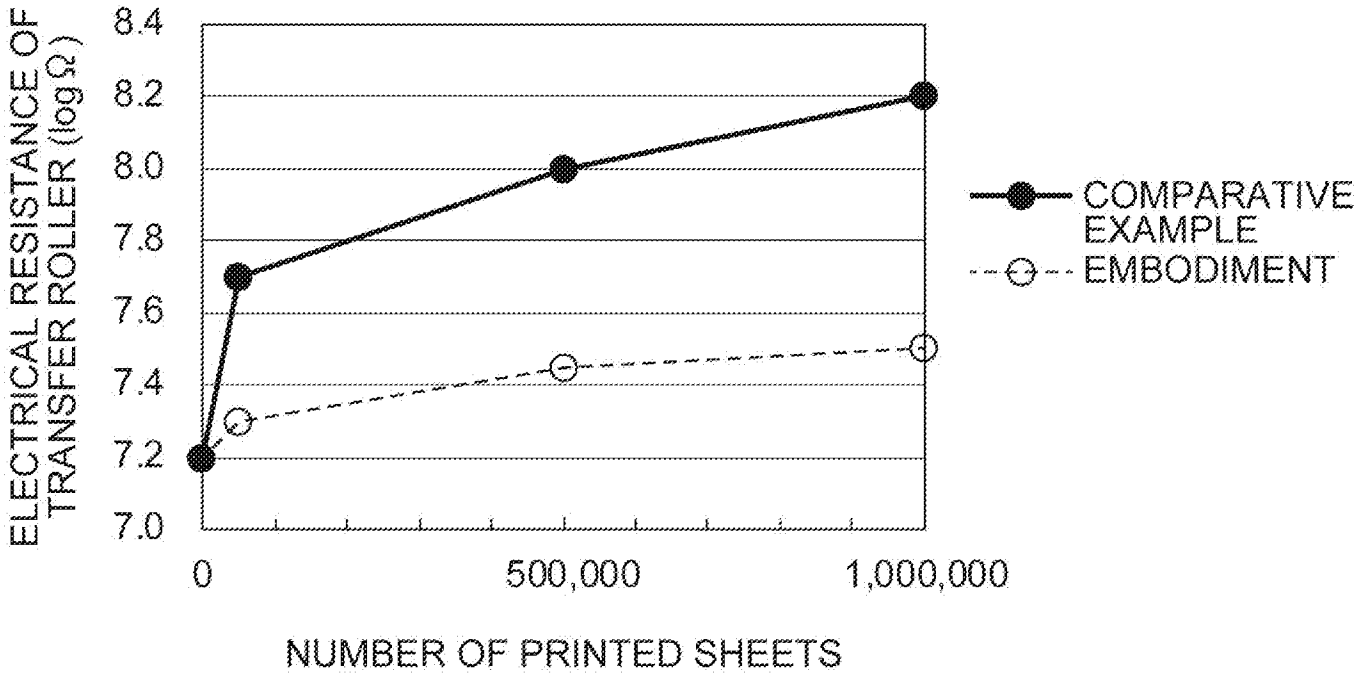
FIG. 8 is an graph showing the electrical resistance in relation to the number of printed sheets for an example transfer roller and for a transfer roller according to a comparative example.

In addition, it is possible to further reduce an uneven distribution of the ionic conductive agent on the surface 34*b* of the transfer roller 34 when a bias is supplied to the transfer roller 34 from a portion of the surface 34*b* of the transfer roller 34 that is in contact with the conductive device 35. Consequently, as shown in FIG. 8, an increase in the electrical resistance of the transfer roller 34 can be avoided or inhibited. For example, in the comparative example in which a bias current is continuously applied to the shaft 104*b*, the electrical resistance of the transfer roller 104 increased from 7.2 (log Ω) to 7.7 (log Ω) when 50,000 sheets were printed and the electrical resistance reached 8.2 (log Ω) when 1,000,000 sheets were printed.

In the example imaging apparatus 1 in which a bias is supplied to the transfer roller 34 through the conductive device 35 during a printing operation, an increase in the electrical resistance of the transfer roller 34 is reliably suppressed or inhibited since the electrical resistance increased from about 7.2 (log Ω) to 7.5 (log Ω) even when 1,000,000 sheets were printed.

With reference to FIG. 2, the transfer roller 34 may be held by the transfer belt 31, the conductive device 35, and the support member 37 which is separate from the transfer belt 31 and the conductive device 35. Accordingly, the transfer roller 34 can be held or supported at least in part by the support member 37 provided as a member separate from the transfer belt 31 and the conductive device 35.

The support member 37 may be a support roller which is rotatable along with the transfer roller 34, and may support the transfer roller 34, to improve a stability of the rotation of the transfer roller 34. The power source 36 may supply a bias to the transfer roller 34 through the support member 37, to more effectively use the support member 37 as a part or member that supplies a bias to the transfer roller 34.

The conductive device 35 may be a conductive roller for a simpler and easier configuration. In addition, as illustrated in FIG. 4, the support member 67 may include the curved surface 67*b* which contacts the surface 34*b* of the transfer roller 34 and substantially follows the surface 34*b* of the transfer roller 34, for a smoother contact surface of the support member 67 with respect to the surface 34*b* of the transfer roller 34.

As illustrated in FIG. 5, the conductive device 75 may include two contact points 75*a*, 75*b* to contact the surface 34*b* of the transfer roller 34, and the transfer roller 34 may be held by the transfer belt 31 and the two contact points 75*a*, 75*b* of the conductive device 75, to avoid the necessity of a separate support member that supports the transfer roller 34, and thereby reduce the number of parts. In some examples, the conductive device 75 may have a recessed shape that covers or extends adjacent a part of the transfer roller 34, to simplify the shape of the conductive device 75.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An imaging system comprising:

a transfer belt;

a driving roller to rotate, wherein the driving roller engages the transfer belt to move the transfer belt;

a transfer roller located adjacent the driving roller, wherein the transfer belt is interposed between the transfer roller and the driving roller to form a transfer nip portion between the transfer roller and the transfer belt, and wherein the transfer roller includes a hollow portion to cause the transfer roller to deform when subjected to an external force;

a conductive device to contact a surface of the transfer roller; and a power source electrically connected to the conductive device, to supply a bias to the transfer roller through the conductive device, wherein the transfer roller includes a hole that forms the hollow portion and a shaft extending in the hole, along an axial direction of the transfer roller, and wherein the hole has an inner diameter greater than an outer diameter of the shaft such that a portion of an outer circumference of the shaft is not in contact with an inner surface of the hole.

2. The imaging system according to claim 1, wherein the transfer roller has a tubular body including a base layer which is an innermost layer in a radial direction of the tubular body, and a surface layer over the base layer, which is an outermost layer in the radial direction of the tubular body, wherein a volume resistance value of the surface layer is greater than a volume resistance value of the base layer, and wherein surface resistivity of the surface layer is greater than surface resistivity of the base layer.

3. The imaging system according to claim 1, wherein the transfer roller is supported by least three holding portions that are included in at least the transfer belt and the conductive device, and wherein one of the at least three holding portions is located on a side of the transfer roller that is opposite the transfer nip portion.

4. The imaging system according to claim 3, wherein the transfer roller is supported by the transfer belt, the conductive device, and a support member separate from the transfer belt and the conductive device.

5. The imaging system according to claim 4, wherein the support member is a support roller to rotate with the transfer roller.

6. The imaging system according to claim 4, wherein the support member includes a curved surface which contacts the surface of the transfer roller, wherein the curved surface is curved so as to substantially follow the surface of the transfer roller.

7. The imaging system of claim 4, wherein the support member is located midway along a circumference of the transfer roller between the transfer nip portion and a second nip portion formed where the conductive device contacts the transfer roller.

8. The imaging system according to claim 3, wherein the conductive device has two contact points contacting a surface of the transfer roller, and wherein the transfer roller is supported by the transfer belt and the two contact points of the conductive device.

9. The imaging system according to claim 1, wherein the driving roller is a backup roller which tensions the transfer belt, and wherein the transfer nip portion is set to a constant pressure by the backup roller.

10. The imaging system according to claim 1, wherein the transfer roller includes a tubular body that forms the hollow portion, wherein the tubular body has a thickness in a radial direction of the transfer roller, wherein the transfer nip portion corresponds to a first nip portion, and wherein a second nip portion is formed where the conductive device contacts the transfer roller, and wherein a distance from the first nip portion to the second nip portion is equal to or greater than the thickness of the tubular body of the transfer roller.

11. The imaging system according to claim 1, wherein a position of the driving roller is fixed relative to a position of the conductive device.

12. The imaging system according to claim 1, wherein the conductive device is disposed so as to press the transfer roller against the transfer belt.

13. The imaging system according to claim 1, wherein the portion of the outer circumference of the shaft that is not in contact with the inner surface of the hole includes more than half of the outer circumference of the shaft.

14. An imaging system comprising:

a transfer belt that is rotatable;

a transfer roller having a tubular body and a hollow portion within the tubular body, wherein the tubular body is made of an elastic material and includes a surface that contacts the transfer belt; and a conductive device to contact the surface of the transfer roller, to supply a bias to the transfer roller, wherein the transfer roller includes a hole that forms the hollow portion and a shaft extending in the hole, along an axial direction of the transfer roller, and wherein the hole has an inner diameter greater than twice an outer diameter of the shaft such that a portion of an outer circumference of the shaft is not in contact with an inner surface of the hole.

* * * * *